US007467646B2

(12) United States Patent
Mettler et al.

(10) Patent No.: US 7,467,646 B2
(45) Date of Patent: Dec. 23, 2008

(54) HEDDLE FOR WARP THREADS IN THE SHAPE OF A BAND

(75) Inventors: Franz Mettler, Wollerau (CH); Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/635,658

(22) Filed: Dec. 8, 2006

(65) Prior Publication Data

US 2007/0144603 A1 Jun. 28, 2007

(30) Foreign Application Priority Data

Dec. 8, 2005 (EP) ..... 05026818

(51) Int. Cl.
*D03C 9/02* (2006.01)
*D03C 9/04* (2006.01)
*D03C 13/00* (2006.01)

(52) U.S. Cl. ..... 139/92; 139/93; 139/94; 139/95; 139/96

(58) Field of Classification Search ..... 139/52, 139/53, 93, 94, 95, 96
See application file for complete search history.

(56) References Cited

U.S. PATENT DOCUMENTS

| | | | | |
|---|---|---|---|---|
| 3,960,182 | A * | 6/1976 | Schwarz | 139/91 |
| 5,052,446 | A * | 10/1991 | Gysin | 139/93 |
| 5,474,110 | A * | 12/1995 | Mettler | 139/93 |
| 6,105,623 | A * | 8/2000 | Tonz et al. | 139/93 |
| 6,176,270 | B1 * | 1/2001 | Mettler | 139/93 |
| 6,230,756 | B1 * | 5/2001 | Baumann et al. | 139/93 |
| 6,283,163 | B1 * | 9/2001 | Kagi | 139/93 |
| 6,883,553 | B2 * | 4/2005 | Bassi et al. | 139/93 |
| 6,883,554 | B2 * | 4/2005 | Baumann et al. | 139/93 |
| 6,955,191 | B2 * | 10/2005 | Hockemeyer et al. | 139/52 |
| 7,017,620 | B2 * | 3/2006 | Mettler et al. | 139/93 |
| 7,131,465 | B1 * | 11/2006 | Chapman | 139/93 |
| 7,204,274 | B2 * | 4/2007 | Mettler | 139/93 |
| 7,285,745 | B2 * | 10/2007 | Simoen | 219/121.64 |
| 7,287,554 | B2 * | 10/2007 | Mathews | 139/93 |
| 2003/0145898 | A1 * | 8/2003 | Bassi et al. | 139/95 |
| 2003/0150506 | A1 * | 8/2003 | Baumann et al. | 139/93 |
| 2005/0016613 | A1 * | 1/2005 | Mettler et al. | 139/93 |
| 2005/0087252 | A1 * | 4/2005 | Mettler | 139/92 |
| 2007/0000552 | A1 * | 1/2007 | Mettler et al. | 139/52 |
| 2007/0131301 | A1 * | 6/2007 | Mettler | 139/52 |

FOREIGN PATENT DOCUMENTS

| | | |
|---|---|---|
| DE | 22996 | 6/1882 |
| GB | 605 893 | 8/1948 |

* cited by examiner

*Primary Examiner*—Bobby H Muromoto, Jr.
(74) *Attorney, Agent, or Firm*—Norman N. Kunitz; Fitch, Even, Tabin & Flannery

(57) ABSTRACT

The heddle according to the invention, provided in particular for band-shaped warp threads, comprises two bands (5, 6) that extend in vertical direction during use, are arranged at a distance parallel to each other and hold two thread support elements (16, 17) disposed between them. The thread support elements (16, 17) together with the respective flat segments of the bands (5, 6) between them jointly form a flat thread eyelet (18) that is oriented transverse to the warp thread and the longitudinal direction (7) of the heddle. The bands (5, 6) preferably extend with undiminished width up to the heddle support rails (2, 3) and are provided with end eyelets (10, 11, 12, 13) for positioning them on the support rails.

17 Claims, 6 Drawing Sheets

HEDDLE FOR WARP THREADS IN THE SHAPE OF A BAND

CROSS REFERENCE TO RELATED APPLICATION

This application claims the priority of European Patent Application No. 05 026 818.4, filed on Dec. 8, 2005, the subject matter of which, in its entirety, is incorporated herein by reference.

BACKGROUND OF THE INVENTION

The invention relates to a heddle for warp threads in the form of flat fiber bundles in the shape of a band.

The weaving industry uses so-called weaving shafts or frames for the shed forming, which basically consist of a rectangular frame having vertical side supports and horizontal bars, arranged at a distance to each other, which are called shaft staves. The shaft staves carry heddle support rails in the form of steel rails extending along the shaft staves, wherein these in most cases have an approximately rectangular cross section. Heddles, which sit with their end eyelets on the heddle support bars, are disposed inside these heddle support bars. Each heddle is provided with at least one thread eyelet through which a warp thread extends. If the shafts with heddles are moved vertically up and down, the respective threads are guided out of the warp thread plane and back into this plane.

More and more in recent times, the object is to form sheds with fiber bands, used instead of the normally used warp threads, for example for producing technical textiles and in particular composite fiber materials or high-strength, for example shot-proof textiles. As a rule, the band-shaped warp threads for producing these materials must be worked flat into the textile material, meaning without bunching on the side, wherein the individual fiber bands should furthermore be positioned as close as possible to each other in the textile.

Additional warp threads must furthermore be guided between adjacent heddles, which then pass through the heddles of other weaving shafts and move differently from the initially considered warp threads, wherein sufficient space must also be provided for these warp threads and damage to the warp threads must be prevented.

German Patent document DE-PS 22996 discloses a heddle, consisting of two thin sheet metal strips that are positioned one above the other. The sheet metal strips are bent away from each other in a center section in order to form an eyelet, thereby creating an oval eyelet that is larger in longitudinal heddle direction than in transverse heddle direction. A heddle of this type is not suitable for the weaving with fiber bands.

Based on this, it is the object of the present invention to create a heddle, which can be used for the weaving with fiber bands.

SUMMARY OF THE INVENTION

The above object generally is solved by the heddle according to the invention which is provided with at least two bands extending in longitudinal direction and is provided with a means for positioning it on a heddle support rail. In the eyelet region, the two bands are respectively position in a single plane, which extends parallel to the guided warp thread and thus parallel to the movement direction for the warp thread, as well as parallel to the shaft movement direction. Thread support elements are positioned between the bands, which between them define a thread eyelet. The eyelet formed in this way has extremely narrow webs on the side, wherein these have high tensile strength. The band-shaped warp threads can therefore be guided while positioned close to each other, which is desirable for creating a dense textile material.

The two thread support elements disposed between the bands form together with the bands on the side a thread eyelet with essentially rectangular cross section, which aids the conditions for guiding flat, band-shaped warp threads. A deformation of the band-shaped warp threads during the shed forming is thus mostly precluded. The individual filaments of the band-shaped warp thread are guided parallel to each other.

The bands extend at least from one thread support element to the other thread support element. In addition, they can each extend to an end eyelet that forms the means for positioning the heddle on the heddle support rail. The end eyelet can be attached to the band or formed from the band itself, for example by respectively stamping or otherwise working identical recesses into the bands, through which the heddle support rail can extend. Alternatively, end eyelet elements fashioned from the same material as the bands or from other types of materials can also be attached to the bands, for example by gluing, welding or riveting them to the bands, wherein other connecting options can also be considered.

The bands are preferably embodied identical. The heddle is furthermore preferably embodied on the whole symmetrical to a center plane, wherein this center plane extends parallel to the flat sides of the two bands and is thus positioned in the center between the two bands, which allows high operating speeds.

The bands consist of a suitable flat material and in particular a metal, for example steel. However, they can also by composed of a composite fiber material, for example a carbon fiber-reinforced plastic. Composite fiber materials with directed fibers are preferably used in that case, for example with fibers oriented in longitudinal direction of the respective band. Particularly lightweight and high-strength heddles can be produced in this way.

The bands, which are preferably arranged surface-parallel to each other, are embodied completely flat according to one preferred embodiment and thus maintain a uniform spacing over the complete length. This embodiment has the advantage that during the operation the bands are stressed only with respect to tension and pressure and that no bending stresses occur. The lightweight heddles are thus stable and can be subjected to high stresses.

One or several spacers can be provided between the bands for keeping the distance between the heddles constant at the respective location, e.g. directly adjacent to the end eyelets. This measure prevents the end eyelets on the heddle support rail from jamming, for example when the heddles are pushed onto the heddle support rails during the fitting of components onto the weaving shaft. The spacers can be metal or plastic spacers, wherein the latter can be used to obtain a lower heddle weight.

The thread support elements are preferably embodied as pins that are held with their ends against the bands. The thread support elements can be bodies having a cylindrical, tubular, hollow or similar shape. Tubular and hollow-profile bodies have the advantage of providing a large and, at the same time, generously rounded support surface for the warp threads, while the weight of the thread support elements and thus the heddle remains low. The thread support elements can consist of hardened steel, hard alloy, or ceramic, wherein they can consist completely or only partially of the aforementioned material. For example, the thread support elements can be embedded into a plastic body or can be connected to a plastic body, which is held between the heddle bands and carries the thread support elements. If applicable, the thread support elements can additionally be connected at the ends to the bands, in particular to prevent at said location the forming of a gap into which warp threads could squeeze. The aforementioned plastic elements can thus function to support the thread support elements while the total weight is reduced.

The thread support elements preferably are held in place immovably by the bands, wherein they rest full surface with their ends against the bands, as previously mentioned. Heddles of this type are suitable for guiding band-shaped warp threads, for example composed of fiber bundles that are positioned loosely next to each other but are not connected to each other, wherein these are embodied in the form of rovings. This is advantageous, particularly for producing technical textiles, which are intended as fiber cores for composite fiber materials. In order to process highly sensitive fibers, the thread support elements can also be made of plastic, which can be selected so as to reduce friction.

Additional details of advantageous embodiments of the invention are the subject matter of the drawing, the specification, or the dependent claims.

BRIEF DESCRIPTION OF THE DRAWINGS

Exemplary embodiments of the invention are illustrated in the drawing which shows in.

DETAILED DESCRIPTION OF THE INVENTION

Figure 1:
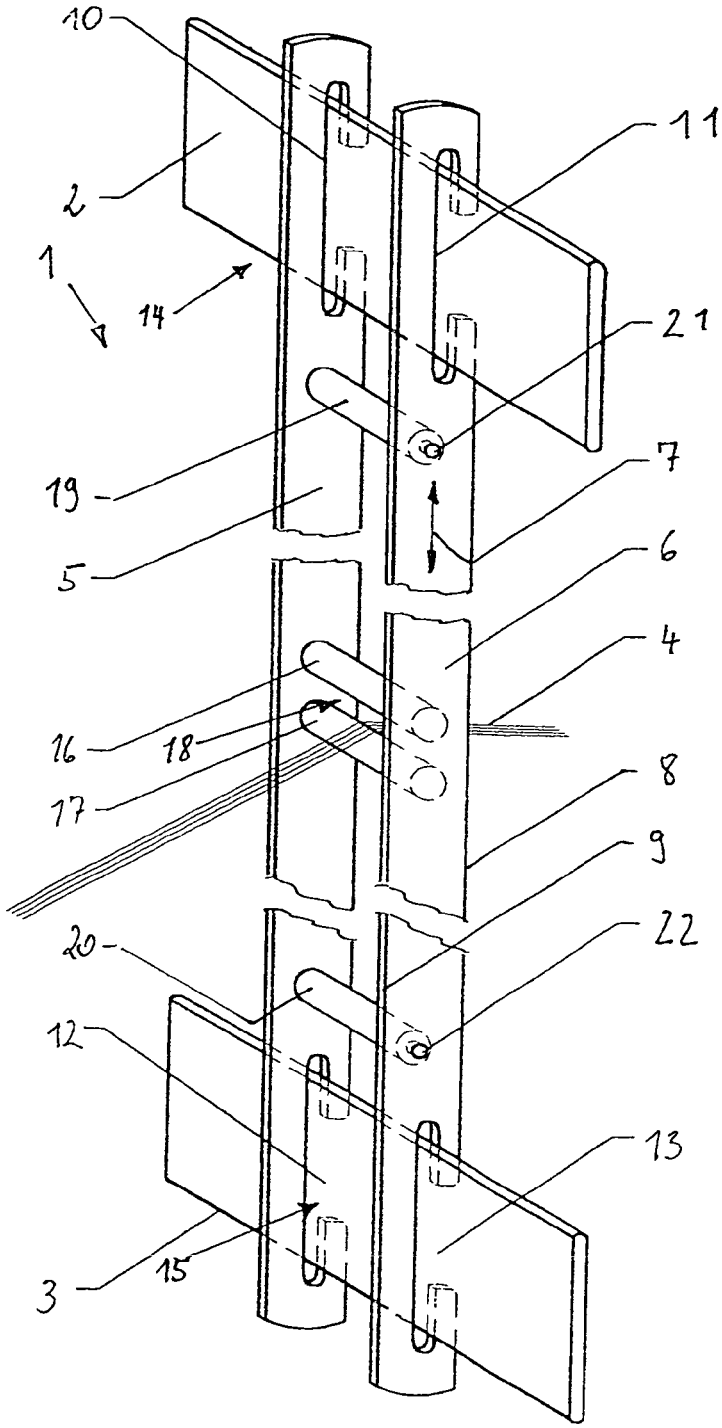
FIG. 1 A heddle according to the invention, supported on two heddle support rails, which are shown in a schematic, perspective view.

FIG. 1 illustrates a heddle 1, disposed between two heddle rails 2, 3 that are positioned parallel at a distance to each other, on a weaving loom shaft that is otherwise not shown herein. The heddle is used for the shed forming with band-shaped warp threads, for example consisting of individual threads positioned loosely next to each other. The warp threads 4 consequently form a band and can also be called band-shaped warp threads. These threads are composed, for example, of carbon fibers, aramide fibers, or other fibers, particularly synthetic fibers used for producing technical textiles.

The heddle 1 comprises two bands 5, 6, which can take the form of thin sheet steel strips. The bands 5, 6 have a thickness of only 0.1 mm to 0.5 mm, for example, wherein the length in longitudinal direction exceeds the distance between the heddle support rails 2, 3. They are respectively delimited by preferably straight edges 8, 9. The width of each band 5, 6 to be measured between the edges 8, 9 ranges from 1 mm to 80 mm or more. The width of the bands 5 and 6 must be adapted to the fiber band that is used for the weaving and depends thereon. The bands 5, 6 of the heddle 1 for the exemplary embodiment are embodied completely flat, are arranged parallel to each other at a distance, and are shaped identical. The ends of the bands are respectively provided with end eyelets 10, 11, 12 and 13 that are obtained, for example, by punching openings into the end regions of the bands 5, 6. FIG. 1 illustrates so-called C-shaped end eyelets. However, other types of end eyelets, e.g. O-shaped or J-shaped, can also be provided or used. The end eyelets 10, 11, 12 and 13 are preferably embodied such that they correspond to standard dimensions and shapes generally used nowadays for the heddle support rails 2, 3. However, an adaptation to new shapes for heddle support rails 2, 3 is possible without problem. The end eyelets 10, 11, 12 and 13, respectively in pairs, form a device 14 and/or 15 for positioning the bands 5, 6 on the heddle support rails 2, 3 with moderate play in longitudinal direction 7. For the present embodiment, the devices 14, 15 in the form of the end eyelets 10 to 13 are formed integrally with the bands 5, 6. However, it is also possible to attach metal or plastic elements to the bands 5, 6, which function as end eyelets or other fastening mechanisms on the heddle support rails 2, 3.

The bands 5, 6 of one preferred and simple embodiment are thin steel bands. Alternatively, they can also consist of plastic, for example a fiber-reinforced plastic, wherein this applies to the embodiment according to FIG. 1 as well as to all other embodiments described herein.

FIG. 1 shows two thread support elements 16, 17 that are disposed between the bands 5, 6, which between them define a flat passage with substantially rectangular cross section, forming the thread eyelet 18 of the heddle 1. It is preferable if the distance between the bands 5, 6 in this case should be considerably longer than the distance between the thread support elements 16, 17. This distance between the bands 5, 6 forms the long edge of the rectangular cross section of the thread eyelet 18. The long edge of the thread eyelet 18 is positioned substantially parallel to the longitudinal direction of the heddle support rail 2, 3, meaning the thread support elements 16, 17 extend essentially parallel to the heddle support rails 2, 3. The thread eyelet in that case is arranged transverse to the longitudinal direction 7 of the bands 5, 6. The thread eyelet opening is fixed in the direction of the warp thread movement 4. In the ideal case, it is arranged at a 90° angle to the direction of the end eyelet recess, which is arranged parallel to the heddle support rail 2, 3, wherein application-specific deviations from this preferred orientation are possible.

The thread support elements 16, 17 preferably have a cylindrical shape, wherein the diameter can be somewhat less than the width of the bands 5, 6, as shown. Alternatively, the diameter of the thread support elements 16, 17 can also coincide with or slightly exceed the width of the bands 5, 6. The thread support elements 16, 17 are composed of hardened steel, for example, which is sufficient for many application cases. For special applications, the thread support elements 16, 17 can also be composed of hard alloy or ceramic material to meet special requirements, for example to be abrasion-resistant or wear-resistant. The support elements can furthermore also consist of a metal support body with a ceramic coating, a ceramic core, or a hard alloy core. These coatings or cores extend respectively over the complete length of the thread support element 16, 17, meaning preferably from a band 5 to the band 6. The two thread support elements 16, 17 can be embodied identical or different with respect to material and shape. The thread support elements 16, 17 can furthermore consist of plastic, for example a plastic material that generates only a slight friction with the warp thread 4 to be guided. The thread support elements 16, 17 can furthermore be composed of a different material, such as a metal provided with a plastic coating or they can support, for example, a hollow-cylindrical plastic element. The thread support surfaces of the thread support elements 16, 17 are preferably oriented at a right angle to the bands 5, 6 and are embodied straight in perpendicular direction, relative to the bands 5, 6.

The thread support elements 16, 17 are preferably connected with their ends securely and non-detachable to the bands 5, 6, for example they can be attached material-to-material to the bands 5, 6. Depending on the selected material, they can also be glued, welded, or riveted to the bands 5, 6, wherein alternatively or additionally a form-locking connection is possible between the thread support elements 16, 17 and the bands 5, 6. For example, rivets can be formed onto the thread support elements 16, 17, which extend through openings in the bands 5, 6 and form a rivet head on the outside. The thread support elements 16, 17 can furthermore be embodied hollow, wherein a rivet can extend through the support elements and the bands 5, 6 and hold the bands 5, 6 securely against the thread support elements 16, 17. The cylinder-shaped (circular cylinder or other type of cylinder) thread support surfaces, defined by the thread support elements 16, 17, thus extend continuously from band 5 to band 6, wherein no gap remains between the bands 5, 6 and the thread support elements 16, 17. The thread support elements 16, 17 therefore adjoin the bands 5, 6 seamlessly.

Figure 6:
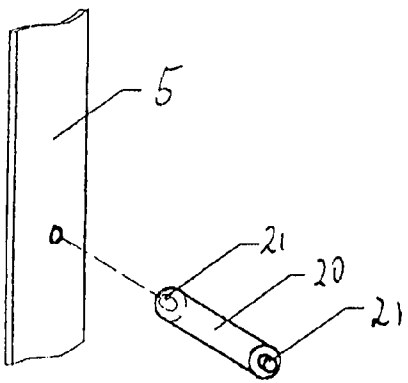
FIG. 6 A view showing a detail of the heddle band with spacers, in a perspective explosive representation.

The heddle 1 can additionally be provided with spacers 19, 20 that are preferably arranged near the end eyelets 10 to 13. The spacers are embodied as plastic pins, for example composed of a thermoplastic plastic, and are provided with pegs 21, 22 (FIG. 6) that extends through corresponding openings in the bands 5, 6 and are melted slightly on the flat outer side in order to form a mechanical fastening in the manner of a rivet head. The spacers can furthermore also be shaped like disks, webs, or cubes.

The heddle 1 described so far can be inserted into a weaving loom with standard shaft in which case the heddles 1, as shown in FIG. 1, are lined up successively on the heddle support rails 2, 3 and the band-shaped warp threads 4 pulled through. The warp threads 4 can thus run through the thread eyelets 18 of the heddles 1, as well as the area between adjacent heddles. For the weaving operation, the shaft and the heddles 1 move up and down in the operating cycle of the weaving loom and, in a manner known per se, weft threads are picked.

The heddle 1 according to the invention allows the warp threads 4 to be guided without bunching on the side, wherein adjacent warp threads can be positioned immediately next to each other because of the slight thickness of the bands 5, 6.

Figure 2:
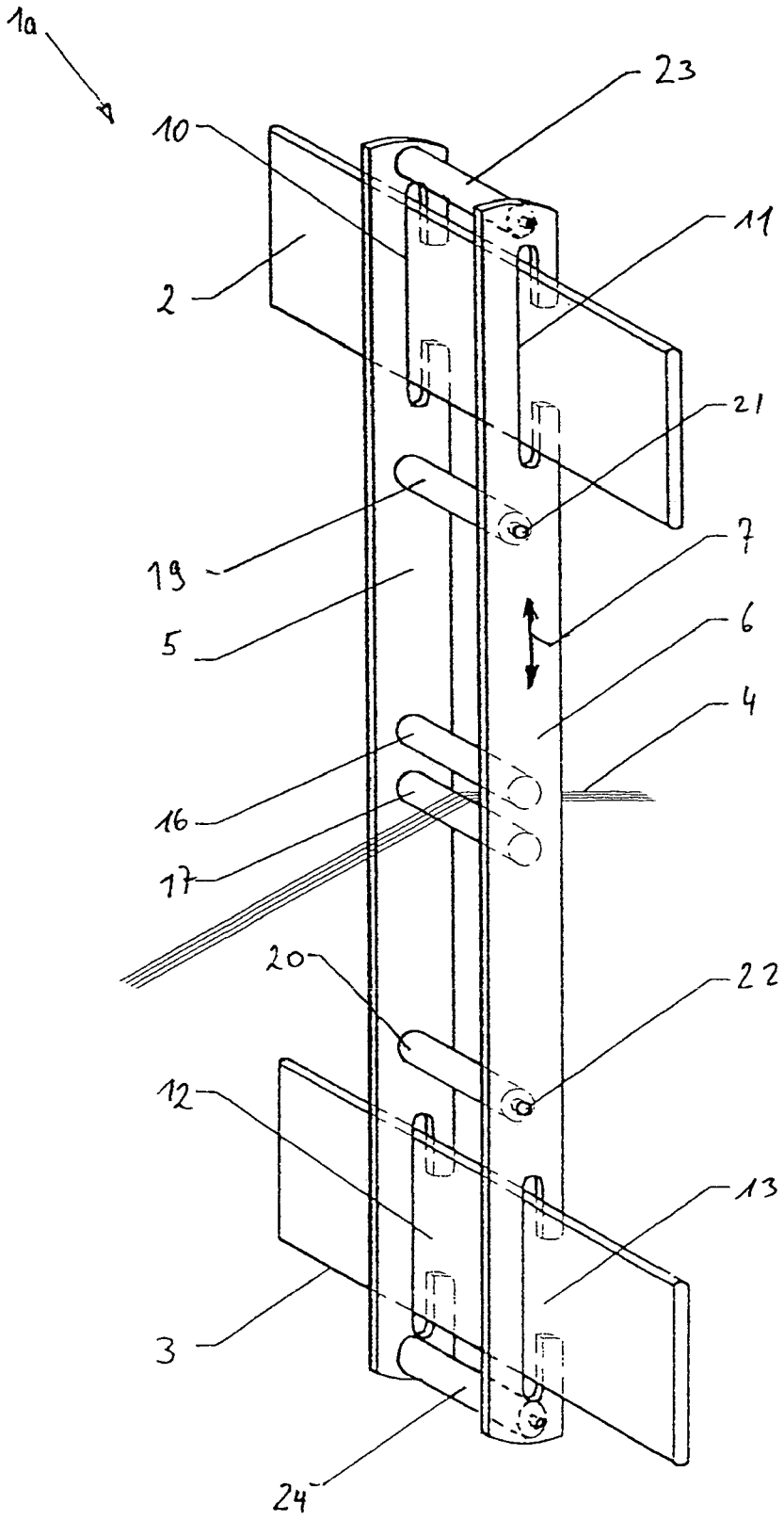
FIG. 2 A modified embodiment of the heddle according to FIG. 1, shown in a schematic and perspective view.

FIG. 2 illustrates a modified embodiment 1*a* of a heddle, using the previously introduced reference numbers, wherein we also refer to the above description, which applies in this case.

In addition, we want to point out that the heddle 1*a* is provided with additional spacers. The spacers 23, 24, for example, are arranged at the free ends of the bands 5, 6, above the upper heddle support rail 2 and/or below the lower heddle support rail 3. The spacers 19, 20 can be provided additionally or can also be omitted. The spacers 19, 20, 23, 24 can be embodied as shown, in the shape of cylindrical pins, or can be embodied differently, wherein they are preferably made of plastic.

Figure 3:
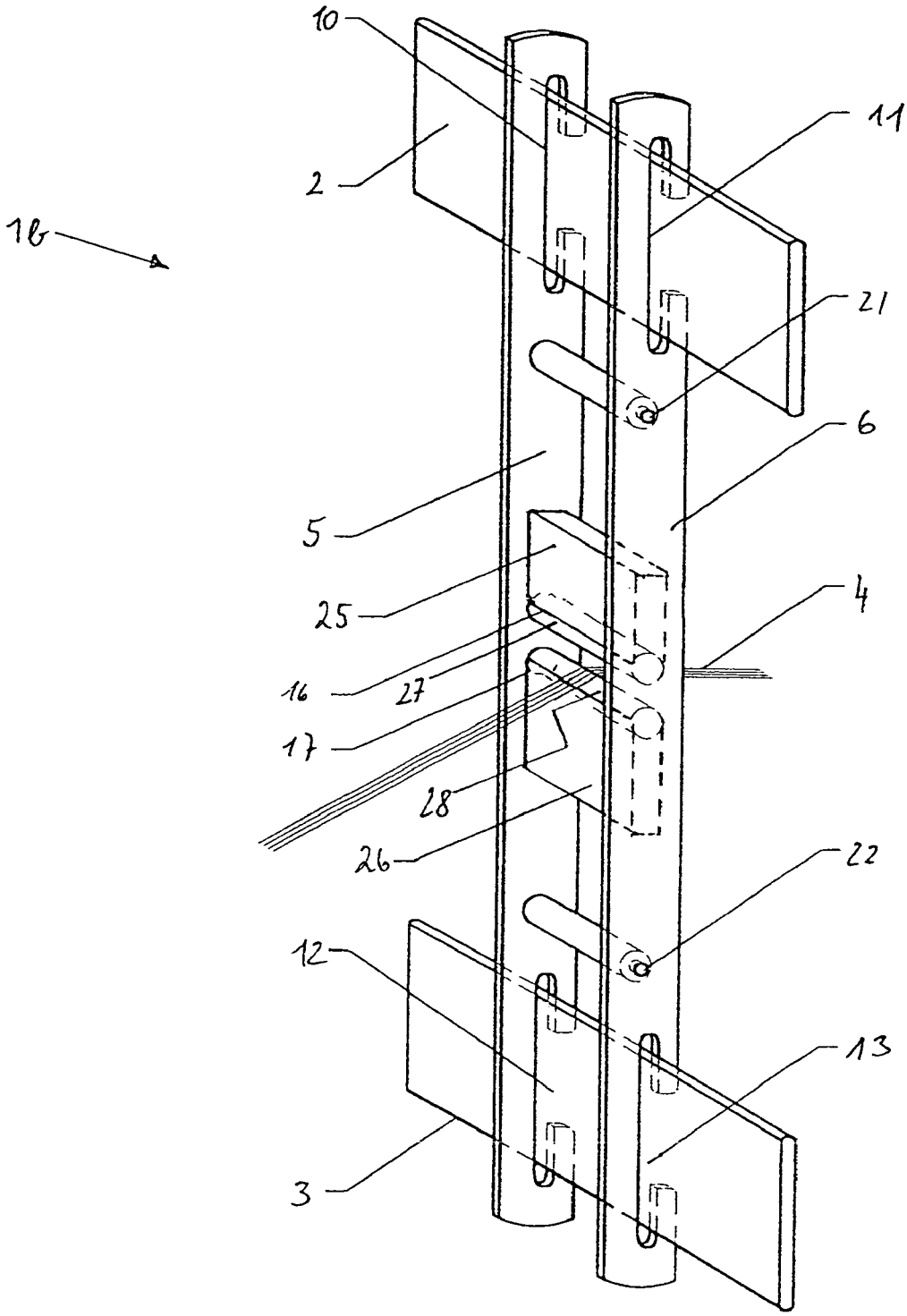
FIG. 3 A different modified embodiment of the heddle according to the invention in a perspective view.

FIG. 3 illustrates a different embodiment of the invention in the form of a heddle 1*b*, which differs from the above-described heddles 1, 1*a* by the thread support elements 16, 17. Otherwise, the above description for FIG. 1 or FIG. 2 applies. The thread support elements 16, 17 in that case consist of respectively one support body 25, 26 with a thread guiding element 27, 28 positioned thereon. The support body 25, 26 can be cube-shaped, for example, and can be embodied as plastic element. The thread guiding elements 27, 28, for example, can be in the shape of a cylinder, bar, U-shaped profile, or the like, which are supported by the support body 25, 26. They can be connected material-to-material, positively interlocking, or with a combination thereof to the support body 25, 26. The support bodies 25, 26 are connected material-to-material or positively interlocking with the bands 5, 6, for example by gluing, welding or riveting them on. The thread guiding elements 27, 28 can additionally be connected material-to-material with the bands 5, 6 in order to prevent a gap from forming between the thread-support surface of the respective thread guiding element 27, 28 and the bands 5, 6.

The embodiment according to FIG. 3 is of interest, particularly for application cases where a low weight is important. The support bodies 25, 26 can be embodied of plastic so as to have extremely low weight. The thread guiding elements 27, 28 contribute little to the weight because of the filigree design.

Figure 4:
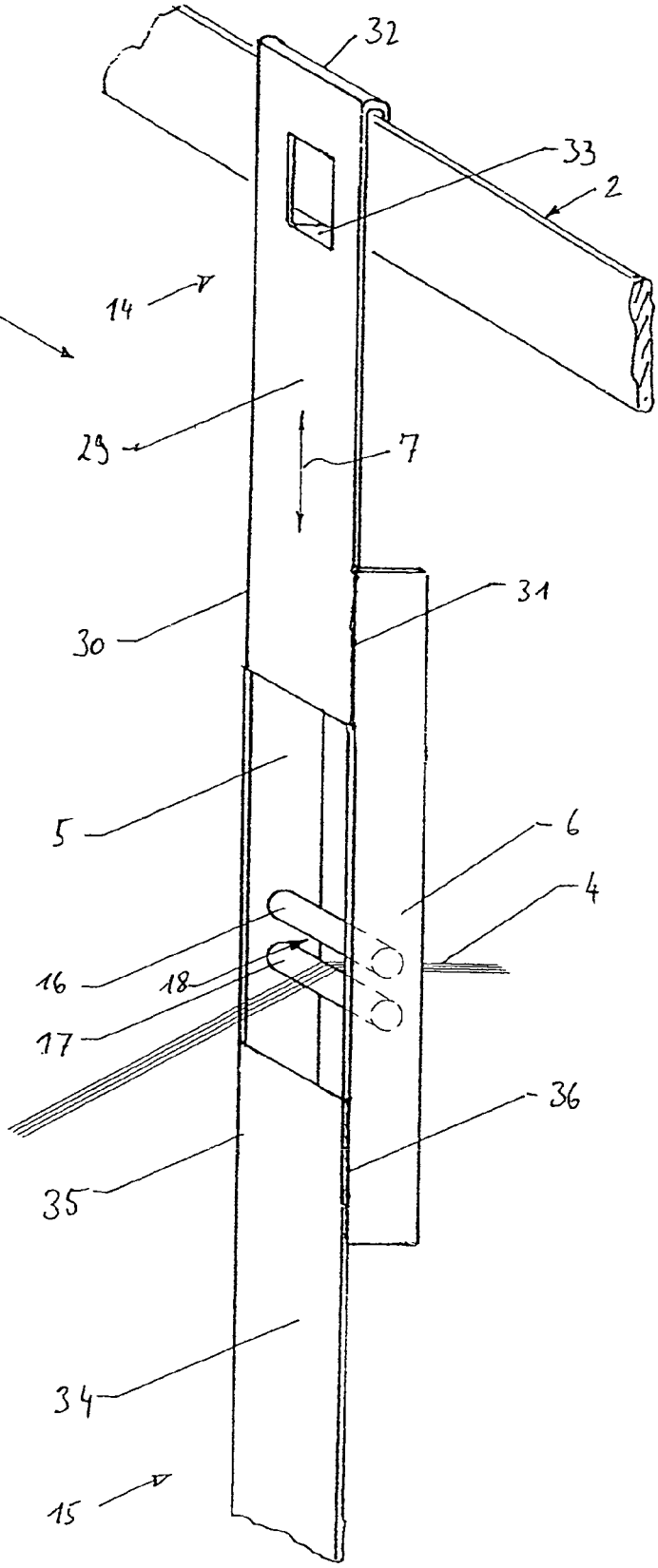
FIG. 4 An embodiment of the heddle according to the invention, showing sections of the embodiment in a perspective basic view.

FIG. 4 illustrates a different embodiment of the invention in the form of a heddle 1*c*. Insofar as nothing else is stated expressly in the following description, the descriptions for FIGS. 1, 2 and 3 apply correspondingly, wherein the same is true especially with respect to the thread support elements 16, 17, which can have any of the above-mentioned shapes.

The bands 5, 6 extend at least slightly past the thread support elements 16, 17 in upward direction and downward direction, wherein this can be symmetrical or asymmetrical, as shown in FIG. 4. The bands 5, 6 can be adjoined by the device 14 and/or 15 for fastening and positioning the heddle 1c on the heddle support rails, of which only the heddle support rail 2 is illustrated. The device 14 consists, for example, of a sheet metal strip that extends as band 29 from the bands 5, 6 to the heddle support rail 2. The band 29 can be completely flat as shown or, if necessary, can also be provided with ribs, depressions, or the like extending in longitudinal direction 7. For the present exemplary embodiment, the band 29 is positioned at a right angle to the bands 5, 6 and is connected thereto by welding seams 30, 31. However, it is also possible to embody the bands 5, 6, 29 as one piece, e.g. in the form of a stamped-out, bent component. The bands 5, 6 in that case can extend slightly past or also up to the heddle support rails 2, 3 as previously mentioned. For fastening the band 29 to the heddle support rail 2, it can be bent in a U shape on the upper end 32, so that it encircles the heddle support rail 2. In addition, a tongue 33 can be stamped out at this end, which then encircles the heddle support rail 2 from below and provides support. In place of this tongue 33, a corresponding sheet metal piece can also be welded to the band 29. The welding seam preferably extends transverse to the longitudinal direction 7.

A different band 34 that connects the bands 5, 6 can correspondingly be provided below the thread eyelet 18, which is connected to the bands 5, 6, so as to form one piece or by means of welding seams 35, 36. The bands 29, 34 can also be inserted between the bands 5, 6, for example in the center.

Figure 5:
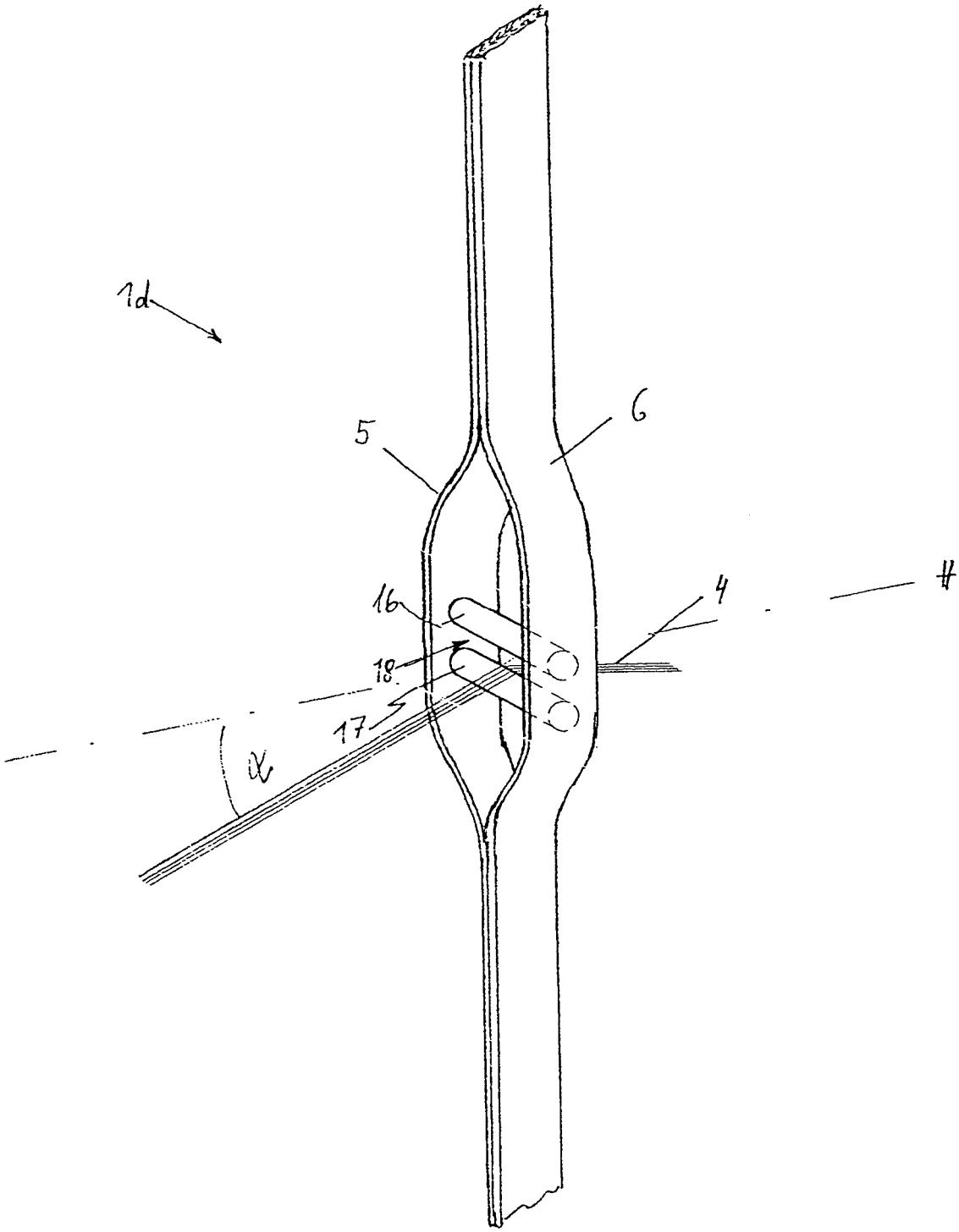
FIG. 5 A different embodiment of the heddle according to the invention, showing sections of the embodiment in a perspective basic view.

FIG. 5 schematically shows a detailed view of a different embodiment of the invention in the form of a heddle 1*d*. For the explanation, we refer to the explanation provided for FIGS. 1 and 3, which applies correspondingly. As for the above-described exemplary embodiments, the heddle 1*d* again has two bands 5, 6, which are oriented parallel to each other in the region of thread eyelet 18. The sections of bands 5, 6 which are oriented parallel to each other in the process extend at least over the two thread support elements 16, 17 and, if applicable, also over an angle a, maximally enclosed by the warp thread 4 together with a horizontal line H that is drawn into FIG. 5, once the weaving shaft is correspondingly moved from the idle position in upward or downward direction to form a weaving shed. At a sufficient distance to the thread eyelet, formed by the thread support elements 16, 17 and the corresponding sections of bands 5, 6, the bands 5, 6 are bent toward each other. The distance between the bending regions and the thread eyelet 18 is large enough, so that the warp thread 4 cannot reach the bending regions. During the further course, the bands 5, 6 then fit against each other, wherein they can be connected to each other, for example, by gluing, riveting, welding, or crimping. At the upper/lower end of the bands 5, 6, in turn, devices are arranged for positioning the bands on the heddle support rails, which can be embodied in the same way or differently from one of the above-described examples, shown in FIGS. 1 to 4.

Figure 7:
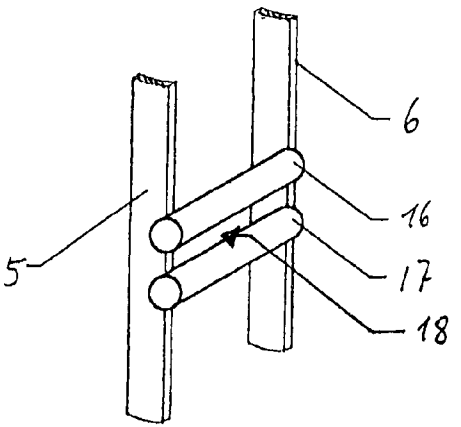
FIG. 7 A different embodiment of a heddle, showing a detail in a perspective representation and FIG. 8 A further embodiment of a heddle according to the invention, showing a detail in a perspective representation.

With the described embodiments according to FIGS. 1 to 5, the thread support elements 16, 17 are arranged symmetrically in a dual sense, namely relative to imagined center lines for the bands 5, 6 as well as symmetrical to a horizontal plane extending through the thread eyelet 18. FIG. 7 illustrates a different embodiment, for which the thread support elements 16, 17 are held off-center on the bands 5, 6. For example, they are inserted into corresponding semi-circular cutouts on the bands 5, 6 and are welded there to the bands, wherein the thread support elements 16, 17 are steel pins, for example. To be sure, the arrangement is still symmetrical relative to a horizontal plane that extends through the thread eyelet 18, but is asymmetrical relative to a vertical plane.

Figure 8:
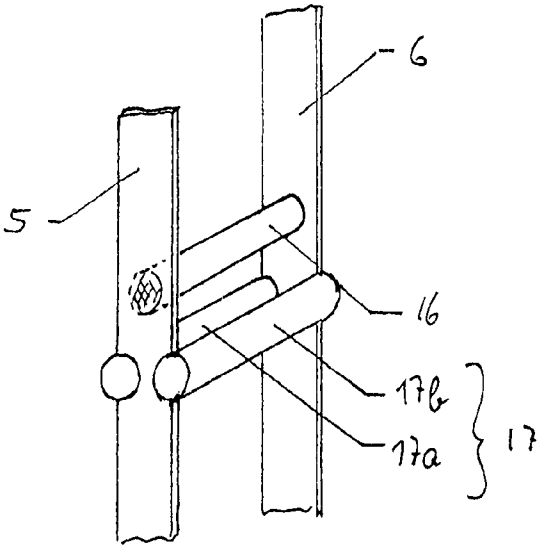

FIG. 8 illustrates a different, modified embodiment which differs in that the lower thread support element 17 is embodied in the form of two preferably spaced-apart thread support elements 17*a*, 17*b*. As shown with the example in FIG. 7, these are attached to the edges of the bands 5, 6, wherein they can be arranged on opposite-arranged edges. The thread-support element 16 is embodied as cylindrical pin and is connected with its ends centrally to the bands 5, 6. If necessary, it can also be arranged off-center or can be replaced by two or more individual elements.

The heddle according to the invention, provided in particular for band-shaped warp threads, comprises two bands 5, 6 that extend during the operation in vertical direction, arranged parallel and at a distance to each other, and which hold between them at least two thread support elements 16, 17. Together with corresponding flat sections of the bands 5, 6, the thread support elements 16, 17 jointly form a flat thread eyelet 18 that is oriented transverse to the warp thread and the longitudinal direction 7 of the heddle. The bands 5, 6 extend preferably with undiminished width up to the heddle support rails 2, 3 and are provided with end eyelets 10, 11, 12 and 13 for the positioning thereon.

Reference Number List:

1, 1*a*, 1*b*, 1*c*, 1*d* heddle
2, 3 heddle support rails
4 warp threads
5, 6 bands
7 longitudinal direction
8, 9 edges
10, 11, 12, 13 end eyelets
14, 15 devices]
16, 17 thread support elements
18 thread eyelet
19, 20 spacer
21, 22 peg
23, 24 spacer
25, 26 support body
27, 28 thread guiding element
29 band
30, 31 welding seam
32 end
33 tongue
34 band
35, 36 welding seams
H horizontal line
L longitudinal direction

The invention claimed is:

1. A heddle for band-shaped warp threads comprising, two bands that extend in a longitudinal direction and are respectively provided on at least one end with a device for positioning on a heddle support rail, with facing side surfaces of said bands, in an eyelet region, being planar, parallel and spaced apart from one another; and extending parallel to a direction of warp thread movement;

at least two parallel thread support elements, which are separate from the bands and spaced from each other in the longitudinal direction, disposed between and having their ends connected to the respective spaced bands to define a rectangular thread eyelet with the facing side surfaces of the bands; and, first and second spacers disposed on respective sides of the thread support elements in the longitudinal direction and connected between the respective side surfaces of the bands for maintaining the bands spaced apart.

2. The heddle according to claim 1, wherein the bands are embodied so as to be identical.

3. The heddle according to claim 1, wherein the bands are composed of a flat material.

4. The heddle according to claim 1, wherein the bands are metal bands.

5. The heddle according to claim 1, wherein the bands are made of a plastic fiber composite material.

6. The heddle according to claim 1, wherein the bands have a flat design along their entire length and are arranged surface-parallel to each other.

7. The heddle according to claim 1, wherein the spacers are produced from a different material than the bands.

8. The heddle according to claim 1, wherein the spacers are made of plastic.

9. The heddle according to claim 1, wherein the device for positioning the heddle on the heddle support rails is an end eyelet, which is formed directly onto one end of each band.

10. The heddle according to claim 1, wherein the thread support elements are embodied as pins, which are held in place with their ends by the bands.

11. The heddle according to claim 1, wherein the thread support elements are provided with a thread support surface, which extends from band to band along a straight line.

12. The heddle according to claim 1, wherein the thread support elements are made from hardened steel, hard alloy, or ceramic material.

13. The heddle according to claim 1, wherein the thread support elements are held in place immovably by the bands.

14. The heddle according to claim 1, wherein the thread support elements are connected full surface with their end surfaces to the side surfaces of the bands.

15. The heddle according to claim 1, wherein the thread eyelet is arranged transverse to the longitudinal direction of the bands.

16. The heddle according to claim 1, wherein the thread eyelet is arranged to be at 90 degree angle to the heddle support rails.

17. The heddle according to claim 1, wherein the thread support elements form the longer side of the rectangular thread eyelet.

* * * * *